US008604720B2

(12) United States Patent
Wang et al.

(10) Patent No.: US 8,604,720 B2
(45) Date of Patent: Dec. 10, 2013

(54) LIGHT EMITTING DIODE DRIVING METHOD

(75) Inventors: Dang-Ko Wang, Hsin-Chu (TW); Hung-Ching Lee, Hsin-Chu (TW); Ching-Chou Yu, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 224 days.

(21) Appl. No.: 13/110,154

(22) Filed: May 18, 2011

(65) Prior Publication Data

US 2012/0049750 A1 Mar. 1, 2012

(30) Foreign Application Priority Data

Sep. 1, 2010 (TW) ..... 99129559 A

(51) Int. Cl.
*H05B 37/02* (2006.01)

(52) U.S. Cl.
USPC ..... 315/360; 315/185 R; 315/294

(58) Field of Classification Search
USPC ..... 315/185 R, 291, 294, 360
See application file for complete search history.

(56) References Cited

U.S. PATENT DOCUMENTS

| | | | | |
|---|---|---|---|---|
| 8,217,592 | B2 * | 7/2012 | Yu et al. | 315/307 |
| 8,305,012 | B2 * | 11/2012 | Ko et al. | 315/307 |
| 2009/0021471 | A1 | 1/2009 | Park et al. | |
| 2009/0146585 | A1 * | 6/2009 | Huang et al. | 315/294 |
| 2009/0267538 | A1 * | 10/2009 | Mantovani | 315/297 |
| 2010/0007290 | A1 | 1/2010 | Urakabe et al. | |
| 2010/0102752 | A1 * | 4/2010 | Chen et al. | 315/294 |
| 2010/0201282 | A1 | 8/2010 | Yu et al. | |
| 2010/0277410 | A1 * | 11/2010 | You et al. | 345/102 |
| 2011/0115394 | A1 * | 5/2011 | Shteynberg et al. | 315/250 |
| 2012/0133292 | A1 * | 5/2012 | Tico et al. | 315/192 |

FOREIGN PATENT DOCUMENTS

| | | |
|---|---|---|
| CN | 101500361 A | 8/2009 |
| JP | 2005252211 | 9/2005 |

OTHER PUBLICATIONS

China Patent Office Action issued Feb. 21, 2012.
Taiwan Patent Office, "Office Action", Jul. 17, 2013.

* cited by examiner

*Primary Examiner* — Jason M Crawford
(74) *Attorney, Agent, or Firm* — WPAT, PC; Justin King

(57) ABSTRACT

An exemplary LED driving method is adapted for driving multiple LED strings. Each of the LED strings includes single one LED or multiple LEDs connected in series. In particular, the LED driving method includes steps of: obtaining an initial value of a duty-on period of a driving current in a frequency period to thereby acquire a target accumulative luminosity in the initial value of the duty-on period for each of the LED strings; and prolonging the duty-on period of the driving current in the frequency period and assuring an accumulative luminosity in the prolonged duty-on period to be substantially equal to the target accumulative luminosity for each of the LED strings, when the maximum one of the initial values of the duty-on periods of the driving currents in the frequency period for the LED strings is shorter than the frequency period.

12 Claims, 4 Drawing Sheets

LIGHT EMITTING DIODE DRIVING METHOD

TECHNICAL FIELD

The present invention relates to light emitting diode (LED) driving technologies, and more particularly to a LED driving method.

BACKGROUND

Nowadays, display panels of non-emissive display devices such as liquid crystal display devices are not self-emissive, and thus backlight sources are necessary to be provided to the display panels for backlight illumination. The backlight sources primarily can be classified into cold cathode fluorescent lamps, hot cathode fluorescent lamps, LEDs and other electroluminescent elements. Specially, since the LEDs have the advantages of high color saturation, without mercury pollution, long operating life, low power consumption and adjustable color temperature, and therefore are increasingly used as the backlight sources of liquid crystal display devices.

Referring to FIGS. 1 and 2, FIG. 1 showing a schematic structural diagram of a conventional LED backlight module, and FIG. 2 showing statuses of driving currents for multiple LED strings during the LED backlight module of FIG. 1 performing a local dimming operation. As illustrated in FIG. 1, the LED backlight module 10 includes a LED driver 12, a power transformer circuit 14 and multiple LED strings e.g., CH1~CH4 (i.e., driving channels). The LED strings CH1~CH4 are independently controlled, and each of the LED strings CH1~CH4 includes multiple LEDs 16 connected in series. Alternatively, each of the LED strings CH1~CH4 may include single one LED 16 instead. The LED driver 12 includes a control circuit 121 and a current sink circuit 123. The control circuit 121 receives a digital input to set duty-on periods of driving currents flowing through the respective LED strings CH1~CH4 in a frequency period and then provides the duty-on periods to the current sink circuit 123 for use. The current sink circuit 123 controls light emitting times of LED for the respective LED strings CH1~CH4 in the frequency period according to the received duty-on periods. Moreover, the current sink circuit 123 is electrically coupled to receive a LED maximum current setting level Iset, and current values $I_{FP}$ of the driving currents for the respective LED strings CH1~CH4 are set to be equal to Iset, for example 20 mA as shown in FIG. 2. The power transformer circuit 14 receives an input voltage Vin and then performs a voltage transforming operation to provide the LED driver 12 with an operating voltage and further provide the LED strings CH1~CH4 with a power supply voltage Vout.

SUMMARY OF DISCLOSURE

Therefore, the present invention is directed to an improved LED driving method.

More specifically, a LED driving method in accordance with an embodiment of the present invention is adapted for driving a plurality of LED strings. Each of the LED strings includes single one LED or multiple LEDs connected in series. In the exemplary embodiment, the LED driving method includes steps of: obtaining an initial value of a duty-on period of a driving current in a frequency period to thereby acquire a target accumulative luminosity in the initial value of the duty-on period for each of the LED strings; and prolonging the duty-on period of the driving current in the frequency period and assuring an accumulative luminosity in the prolonged duty-on period to be substantially equal to the target accumulative luminosity for each of the LED strings, when the maximum one of the initial values of the duty-on periods of the driving currents in the frequency period for the LED strings is shorter than the frequency period.

In one embodiment, the above step of prolonging and assuring includes sub-steps of: prolonging the duty-on period of the driving current in the frequency period according to a first ratio for each of the LED strings; and decreasing a luminosity per unit time in the prolonged duty-on period according to a second ratio for each of the LED strings; the product of the first ratio multiplying the second ratio is equal to 1. Moreover, the first ratio in an exemplary embodiment is a ratio of a target duty-on period to the duty-on period with the maximum one of the initial values of the duty-on periods of the driving currents in the frequency period for the light emitting diode strings.

In one embodiment, the above step of prolonging and assuring includes a sub-step of: prolonging the duty-on period with the maximum one of the initial values of the duty-on periods of the driving currents for the LED strings to be substantially equal to the frequency period.

In one embodiment, the above LED driving method further includes a step of: making start points of the duty-on periods of the driving currents in the frequency period for the LED strings be not completely the same, when the maximum one of the initial values of the duty-on periods of the driving currents for the LED strings is shorter than the frequency period.

A LED driving method in accordance with another embodiment of the present invention is adapted for driving multiple LED strings. Each of the LED strings includes single one LED or multiple LEDs connected in series. In the exemplary embodiment, the LED driving method includes steps of: obtaining an initial value of a duty-on period of a driving current in a frequency period for each of the LED strings, wherein an initial value of a current value of the driving current in the duty-on period for each of the LED strings is a preset value; and prolonging the duty-on period of the driving current in the frequency period according to a first ratio and decreasing the current value of the driving current in the prolonged duty-on period according to a second ratio for each of the LED strings to thereby obtain a plurality of new values of the current values of the driving currents, when the maximum one of the initial values of the duty-on periods of the driving currents in the frequency period for the LED strings is shorter than the frequency period. Moreover, the first ratio and the second ratio are mutually reciprocal. In addition, the first ratio in an exemplary embodiment is a ratio of a target duty-on period to the duty-on period with the maximum one of the initial values of the duty-on periods of the driving currents in the frequency period for the light emitting diode strings.

In one embodiment, the above step of prolonging and decreasing includes sub-steps of: prolonging the duty-on period with the maximum one of the initial values of the duty-on periods of the driving currents for the LED strings to be substantially equal to the frequency period.

In one embodiment, the above LED driving method further includes a step of: shifting start points of some of the duty-on periods of the driving currents in the frequency period, when the maximum one of the initial values of the duty-on periods of the driving currents in the frequency period for the LED strings is shorter than the frequency period.

A LED driving method in accordance with still another embodiment of the present invention is adapted for driving multiple LED strings. Each of the LED strings includes single one LED or multiple LEDs connected in series. In the exemplary embodiment, the LED driving method includes steps of: obtaining an initial value of a light emitting time in a frequency period and an initial value of a luminosity per unit time in the initial value of the light emitting time for each of the LED strings, to thereby acquire a target accumulative luminosity in the frequency period for each of the LED strings; prolonging the light emitting time in the frequency period and decreasing the luminosity per unit time in the prolonged light emitting time for each of the LED strings, when the maximum one of the initial values of the light emitting times in the frequency period for the LED strings is less than the frequency period; and driving each of the LED strings to operate in the corresponding one of the prolonged light emitting times in the frequency period to achieve the target accumulative luminosity.

In one embodiment, the above LED driving method further includes a step of: making start points of the prolonged light emitting times in the frequency period for the LED strings be not completely the same.

In one embodiment, the above step of prolonging and decreasing includes a sub-step of: prolonging the light emitting time with the maximum one of the initial values of the light emitting times in the frequency period for the LED strings to be substantially equal to the frequency period.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF EMBODIMENTS

The present invention will now be described more specifically with reference to the following embodiments. It is to be noted that the following descriptions of embodiments of this invention are presented herein for purpose of illustration and description only. It is not intended to be exhaustive or to be limited to the precise form disclosed.

Figure 1:
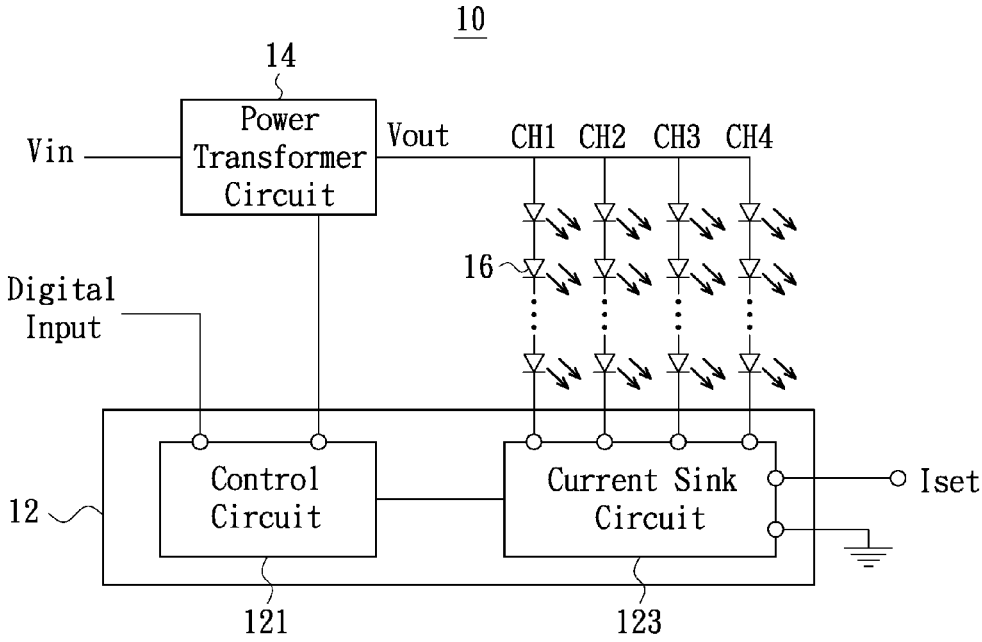
FIG. 1 (Related Art)
FIG. 1 shows a schematic structural diagram of a conventional LED backlight module.
Figure 3:
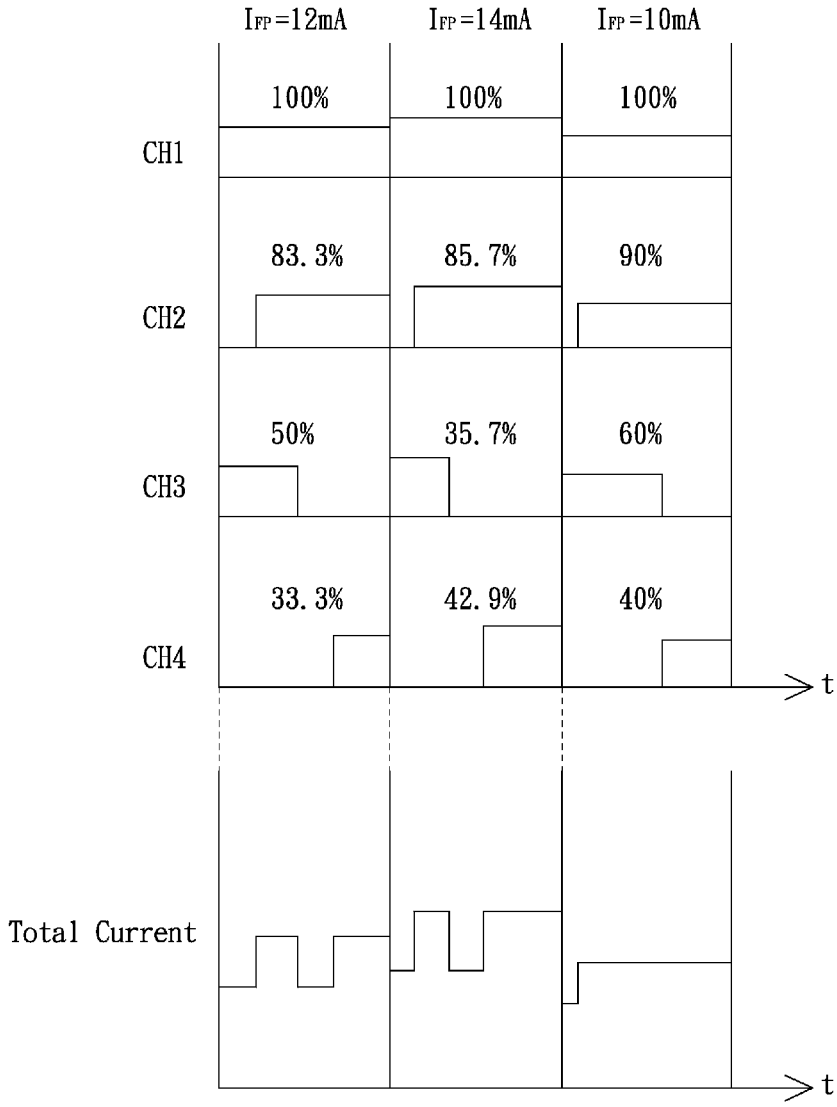
FIG. 3 shows statuses of driving currents for respective LED strings during local dimming in a LED driving method in accordance with an exemplary embodiment of the present invention.

Referring to FIG. 3, statuses of driving currents for respective LED strings during local dimming in a LED driving method in accordance with an embodiment are shown. Herein, it is indicated that, the LED driving method in accordance with the illustrative embodiment of the present invention may be adapted to the LED backlight module of FIG. 1, the designer only is needed to suitably add some additional functions to the control circuit 121 and the current sink circuit 123 in FIG. 1, for example, the control circuit 121 is given the function of adjusting duty-on periods (or duty cycles) of driving currents in a frequency period for the respective LED strings e.g., CH1~CH4, and the current sink circuit 123 is given the function of adjusting current values of the driving currents in the frequency period for the respective LED strings CH1~CH4.

Figure 2:
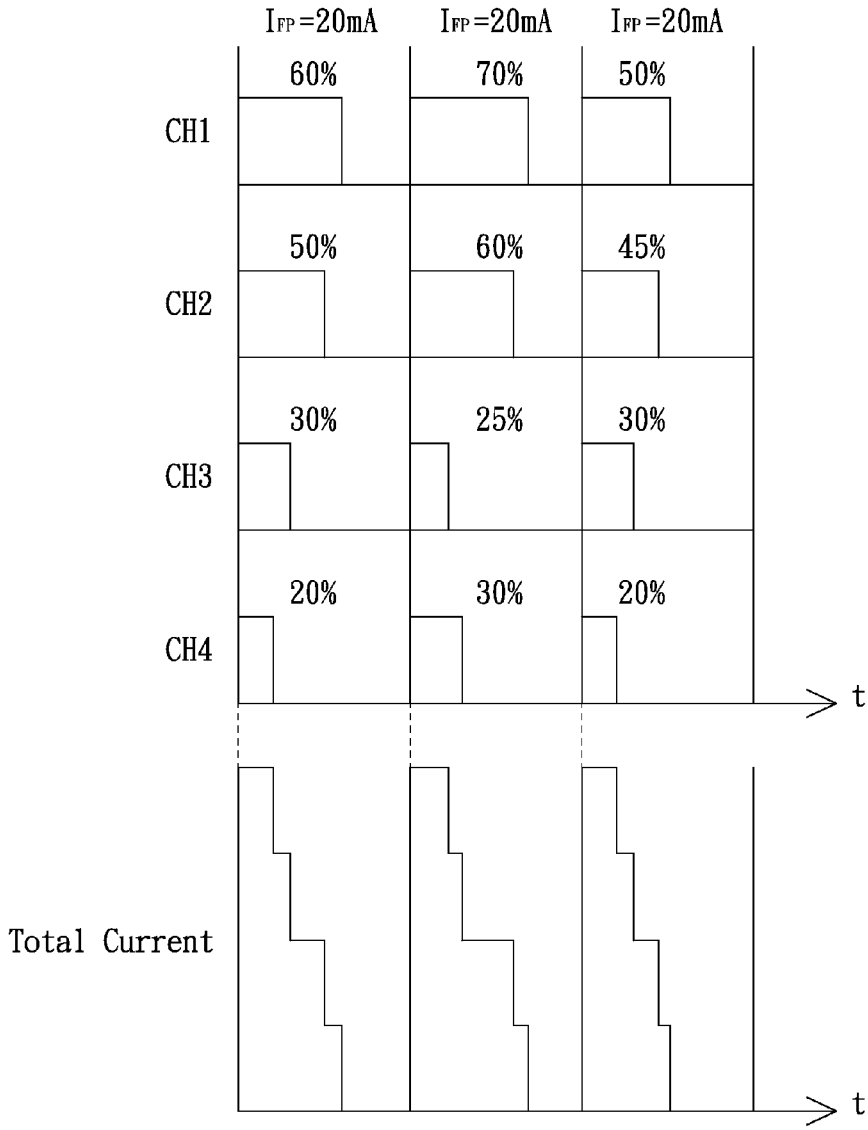
FIG. 2 (Related Art)
FIG. 2 shows statuses of driving currents for respective LED strings during the LED backlight module of FIG. 1 performing a local dimming operation.

In the following, the LED driving method in accordance with the illustrative embodiment of the present invention will be described in detail with reference to the accompanying drawings of FIGS. 2 and 3. FIG. 2 shows initial statuses of the driving currents for the respective LED strings CH1~CH4, and FIG. 3 shows resultant statuses of the driving currents for the respective LED strings CH1~CH4 after adjusting the current values and the duty-on periods of the driving currents for the respective LED strings CH1~CH4 according to the inventive concept of the present invention. The LED strings CH1~CH4 are independently controlled, and each of the LED strings CH1~CH4 includes single one LED or multiple LEDs connected in series.

Specifically, in the LED driving method of the illustrative embodiment of the present invention, an initial value of a duty-on period (or a duty cycle which is the ratio of the duty-on period to the frequency period) of a driving current in a frequency period is firstly obtained to thereby acquire a target accumulative luminosity in the initial value of the duty-on period for each of the LED strings e.g., CH1~CH4. In the illustrative embodiment, initial values of the current values of the driving currents for the respective LED strings CH1~CH4 generally are preset to be a maximum gray-level current level e.g., 20 mA as illustrated in FIG. 2.

Figure 4:
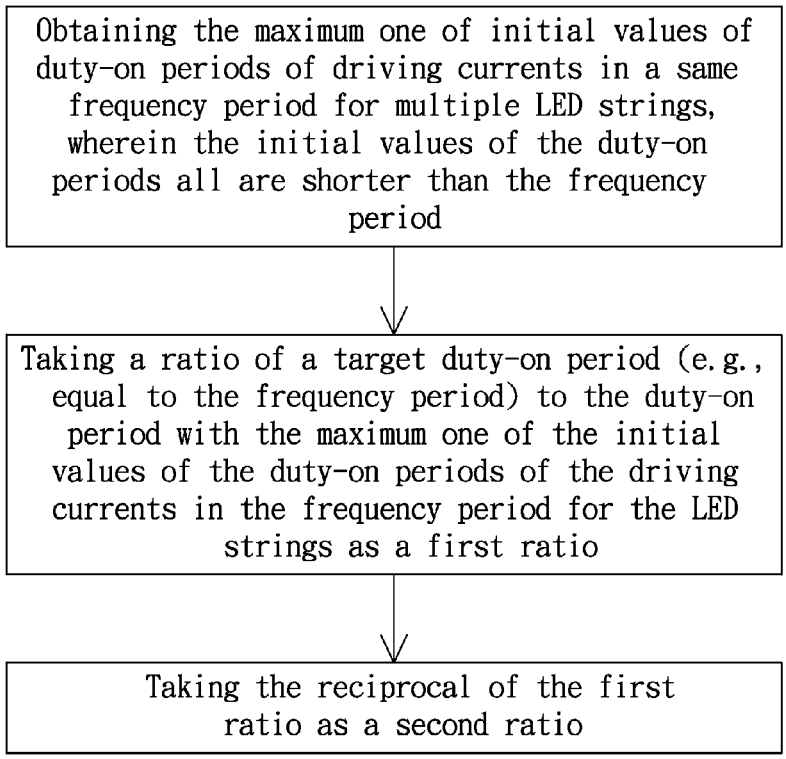
FIG. 4 shows steps of obtaining a first ratio and a second ratio in accordance with an exemplary embodiment.

Subsequently, when the maximum one of the initial values of the duty-on periods (or the duty cycles) of the driving currents in a same frequency period for the LED strings CH1~CH4 is shorter than the frequency period, the duty-on period of each the driving current in the frequency period is prolonged according to a first ratio and the current value of each the driving current is decreased from its initial value according to a second ratio, so that an accumulative luminosity in the prolonged duty-on period is assured to be substantially equal to the target accumulative luminosity for each of the LED strings CH1~CH4. The obtaining of the first ratio and the second ratio can refer to the summarized steps of FIG. 4 Hereinafter, the first frequency period of three successive frequency periods in FIG. 2 and the corresponding first frequency period in FIG. 3 are taken as an example to illustrate the adjustments of duty-on period and current value of the driving currents for the LED strings CH1~CH4, and the adjustments of duty-on period and current value of the driving currents for the LED strings CH1~CH4 in the second and third frequency periods are similar to that in the first frequency period and thus the description thereof will be omitted.

More specifically, in the first frequency period of FIG. 2, the initial values of the duty-on periods of the driving currents for the LED strings CH1~CH4 respectively are 60%, 50%, 30% and 20% of the frequency period. That is, the initial values of the duty cycles of the driving currents for the respective LED strings CH1~CH4 all are less than 100%, which meets the condition that the maximum one of the initial values of the duty-on periods of the driving currents for the respective LED strings is less than 100% of the frequency period, and therefore the duty-on periods and the current values of the driving currents for the respective LED strings CH1~CH4 would be adjusted, and the results of adjustment can refer to the resultant statuses in first frequency period of FIG. 3.

Contradistinctively, in the first frequency period of FIG. 3, since the initial value of the duty-on period of the driving current for the LED string CH1 is the maximum one, and therefore the duty-on period of the driving current for the LED string CH1 is prolonged to be 100% of the frequency period, i.e., the light emitting time of the LED string CH1 is prolonged as a result. Herein, the duty-on period of the driving current for the LED string CH1 is prolonged from the initial value of 60% to 100% of the frequency period, that is, the prolonged duty-on period is 5/3 (i.e., an example of the first ratio) times of the initial value of the duty-on period. In order to assure an accumulative luminosity of the LED string CH1 operating in the prolonged duty-on period (i.e., corresponding to the light emitting time) to be substantially equal to the target accumulative luminosity, the current value of the driving current for the LED string CH1 correspondingly is decreased to be 3/5 (i.e., an example of the second ratio) times of the initial value of the current value, that is the current value $I_{FP}$. is reduced from 20 mA to be (20 mA×3/5)=12 mA, so as to decrease the luminosity per unit time of the LED string CH1. With regard to the other LED strings CH2~CH4, the current values $I_{FP}$ of the driving currents all are set to be equal to the adjusted current value of 12 mA of the driving current for the LED string CH1, and the adjusted/prolonged duty-on periods of the driving currents for the respective LED strings CH2~CH4 respectively are about 83.3%, 50% and 33.3% of the frequency period. Accordingly, it can be found that, although the duty-on periods (or the duty cycles) and the current values of the driving currents for the respective LED strings CH1~CH4 are adjusted, the product of any one of the duty-on periods multiplying the corresponding one of the current values for each of the LED strings CH1~CH4 is kept unchanged, so as to achieve the target accumulative luminosities of the respective LED strings CH1~CH4.

Moreover, it also can be found that, in the first frequency period of FIG. 3, start points of the duty-on periods of the driving currents for the respective LED strings CH1~CH4 are not completely the same, so that the effect of current being uniformly consumed can be achieved. In actual implementations, the start points being not completely the same can be achieved by shifting the start points of duty-on periods of some driving currents for the LED strings CH1~CH4 in the frequency period.

In addition, it is noted that, the present invention is not limited to prolong the maximum one of the initial values of the duty-on periods (or duty cycles) of the driving currents for the respective LED strings to be 100% of the frequency period, and can be prolonged to be other target value according to actual application requirement. In another aspect, the LED driving method of the present invention is not limited to only drive four LED strings as illustrated, and can be applied to other situation with any amount of LED strings.

To sum up, in the above various embodiments of the present invention, by adjusting the current value and the duty-on period of the driving current for each of the LED strings, the LED(s) in each LED string can be operated with a relatively high efficiency, so that the cross voltage loss on LED driver 12 can be reduced and thereby the whole efficiency is improved. In another aspect, by prolonging the light emitting time in the frequency period for each LED string, the turned-off time of LED can be decreased and thereby the power consumption in the turned-off time of LED is reduced as a result. In addition, by making the start points of the duty-on periods of the driving currents for the LED strings be not completely the same, the effect of current being uniformly consumed can be achieved and thereby the ripple of power supply voltage in the prior art is relieved.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A light emitting diode driving method adapted for driving a plurality of light emitting diode strings, each of the light emitting diode strings comprising at least one light emitting diode, the light emitting diode driving method comprising steps of:

obtaining an initial value of a duty-on period of a driving current in a frequency period to thereby acquire a target accumulative luminosity in the initial value of the duty-on period for each of the light emitting diode strings, wherein the duty-on period is an on-duty time of the driving current in the frequency period;

judging the maximum one of the initial values of the duty on periods of driving currents in the frequency period for the light emitting diode strings whether is shorter than the frequency period; and prolonging the duty-on period of the driving current in the frequency period and assuring an accumulative luminosity in the prolonged duty-on period to be substantially equal to the target accumulative luminosity in the initial duty-on period for each of the light emitting diode strings, when the maximum one of the initial values of the duty-on periods of the driving currents in the frequency period for the light emitting diode strings is judged to be shorter than the frequency period.

2. The light emitting diode driving method as claimed in claim 1, wherein the step of prolonging and assuring comprises:

prolonging the duty-on period of the driving current in the frequency period according to a first ratio for each of the light emitting diode strings; and decreasing a luminosity per unit time in the prolonged duty-on period according to a second ratio for each of the light emitting diode strings;

wherein the product of the first ratio multiplying the second ratio is equal to 1.

3. The light emitting diode driving method as claimed in claim 1, wherein the first ratio is a ratio of a target duty-on period to the duty-on period with the maximum one of the initial values of the duty-on periods of the driving currents in the frequency period for the light emitting diode strings.

4. The light emitting diode driving method as claimed in claim 1, wherein the step of prolonging and assuring comprises:

prolonging the duty-on period with the maximum one of the initial values of the duty-on periods of the driving currents for the light emitting diode strings to be substantially equal to the frequency period.

5. The light emitting diode driving method as claimed in claim 1, further comprising a step of:

making start points of the duty-on periods of the driving currents in the frequency period for the light emitting diode strings be not completely the same, when the maximum one of the initial values of the duty-on periods of the driving currents for the light emitting diode strings is shorter than the frequency period.

6. A light emitting diode driving method adapted for driving a plurality of light emitting diode strings, each of the light emitting diode strings comprising at least one light emitting diode, the light emitting diode driving method comprising steps of:

obtaining an initial value of a duty-on period of a driving current in a frequency period for each of the light emitting diode strings, wherein an initial value of a current amplitude value of the driving current in the duty-on period for each of the light emitting diode strings is a preset value, wherein the duty-on period is an on-duty time of the driving current in the frequency period; and prolonging the duty-on period of the driving current in the frequency period according to a first ratio and decreasing the current amplitude value of the driving current in the prolonged duty-on period according to a second ratio for each of the light emitting diode strings to thereby obtain a plurality of new values of the current amplitude values of the driving currents, when the maximum one of the initial values of the duty-on periods of the driving currents in the frequency period for the light emitting diode strings is shorter than the frequency period;

wherein the first ratio and the second ratio are mutually reciprocal.

7. The light emitting diode driving method as claimed in claim 6, wherein the first ratio is a ratio of a target duty-on period to the duty-on period with the maximum one of the initial values of the duty-on periods of the driving currents in the frequency period for the light emitting diode strings.

8. The light emitting diode driving method as claimed in claim 6, wherein the step of prolonging and decreasing comprises:

prolonging the duty-on period with the maximum one of the initial values of the duty-on periods of the driving currents for the light emitting diode strings to be substantially equal to the frequency period.

9. The light emitting diode driving method as claimed in claim 6, further comprising a step of:

shifting start points of some of the duty-on periods of the driving currents in the frequency period, when the maximum one of the initial values of the duty-on periods of the driving currents in the frequency period for the light emitting diode strings is shorter than the frequency period.

10. A light emitting diode driving method adapted for driving a plurality of light emitting diode strings, each of the light emitting diode strings comprising at least one light emitting diode, the light emitting diode driving method comprising steps of:

obtaining an initial value of a light emitting time in a frequency period and an initial value of a luminosity per unit time in the initial value of the light emitting time for each of the light emitting diode strings, to thereby acquire a target accumulative luminosity in the frequency period for each of the light emitting diode strings wherein the light emitting time is corresponding to an on-duty time of the driving current in the frequency period;

judging the maximum one of the initial values of the light emitting times in the frequency period for the light emitting diode strings whether is less than the frequency period;

prolonging the light emitting time in the frequency period and decreasing the luminosity per unit time in the prolonged light emitting time for each of the light emitting diode strings, when the maximum one of the initial values of the light emitting times in the frequency period for the light emitting diode strings is judged to be less than the frequency period; and driving each of the light emitting diode strings to operate in the corresponding one of the prolonged light emitting times in the frequency period to achieve the target accumulative luminosity.

11. The light emitting diode driving method as claimed in claim 10, further comprising a step of:

making start points of the prolonged light emitting times in the frequency period for the light emitting diode strings be not completely the same.

12. The light emitting diode driving method as claimed in claim 10, wherein the step of prolonging and decreasing comprises:

prolonging the light emitting time with the maximum one of the initial values of the light emitting times in the frequency period for the light emitting diode strings to be substantially equal to the frequency period.

* * * * *